US011298938B2

(12) United States Patent
Takasaki

(10) Patent No.: US 11,298,938 B2
(45) Date of Patent: Apr. 12, 2022

(54) LIQUID EJECTION APPARATUS

(71) Applicant: BROTHER KOGYO KABUSHIKI KAISHA, Nagoya (JP)

(72) Inventor: Hironori Takasaki, Ogaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 18 days.

(21) Appl. No.: 17/028,585

(22) Filed: Sep. 22, 2020

(65) Prior Publication Data

US 2021/0094275 A1 Apr. 1, 2021

(30) Foreign Application Priority Data

Sep. 26, 2019 (JP) ..... JP2019-174941

(51) Int. Cl.
*B41J 2/045* (2006.01)

(52) U.S. Cl.
CPC ..... *B41J 2/0451* (2013.01); *B41J 2/04573* (2013.01); *B41J 2/04586* (2013.01)

(58) Field of Classification Search
CPC .. B41J 2/04586; B41J 2/04573; B41J 2/0451; B41J 2/04555
See application file for complete search history.

(56) References Cited

U.S. PATENT DOCUMENTS 11,135,836 B2 * 10/2021 Arakane ..... B41J 2/2142
2006/0157579 A1 7/2006 Komatsu
2007/0139461 A1 6/2007 Izuo
2012/0075372 A1 3/2012 Yamamoto
2014/0300657 A1 10/2014 Ike
2015/0191017 A1 7/2015 Matsumoto et al.

FOREIGN PATENT DOCUMENTS

JP H09-24607 A 1/1997
JP 2006-175849 A 7/2006
JP 4929699 B2 5/2012
JP 5884259 B2 3/2016
JP 2016-147420 A 8/2016
JP 2017-094578 A 6/2017
JP 2017-132045 A 8/2017
JP 6231759 B2 11/2017
JP 6318625 B2 5/2018

* cited by examiner

*Primary Examiner* — Thinh H Nguyen
(74) *Attorney, Agent, or Firm* — Baker Botts L.L.P.

(57) ABSTRACT

There is provided a liquid ejection apparatus including: a head; a carriage; a conveyor; a signal generator configured to output a signal, depending on whether or not a plurality of nozzles include an ejection defective nozzle; a maintenance part; and a controller. The controller executes: ejecting of a liquid toward a medium by performing a ejecting operation of performing a ejecting pass and a conveying operation; before the ejecting operation, determining of whether or not the ejection defective nozzle is present among the plurality of nozzles. In a case that the controller determines that the ejection defective nozzle is present, the controller determines, based on a first time and a second time, whether to perform a first ejecting operation after performing a maintenance operation before the ejecting operation, or to perform a second ejecting operation without performing the maintenance operation before the ejecting operation.

9 Claims, 7 Drawing Sheets

LIQUID EJECTION APPARATUS

CROSS REFERENCE TO RELATED APPLICATION

The present application claims priority from Japanese Patent Application No. 2019-174941, filed on Sep. 26, 2019, the disclosure of which is incorporated herein by reference in its entirety.

BACKGROUND

Field of the Invention

The present disclosure relates to a liquid ejection apparatus which ejects a liquid from a nozzle.

As a liquid ejection apparatus which ejects a liquid from a nozzle, there is a publicly known ink-jet printer which eject an ink from a plurality of nozzles so as to perform recording. In a certain publicly known ink-jet printer, inspection regarding presence or absence of eject of the ink (ink eject) and inspection regarding an eject direction are performed with respect to each of the plurality of nozzles of a head. Further, in a case that there is a nozzle which does not eject the ink and that there is a nozzle of which eject direction is abnormal or unsatisfactory, a maintenance operation is executed, and then the above-described inspections are performed again.

Further, in another ink-jet printer which is publicly known, recording on a recording paper (recording paper sheet, recording sheet) is performed by alternately performing scanning of a recording head in a main scanning direction, and conveyance of the recording paper in a sub-scanning direction. In this ink-jet printer, in a case that there is not any ejection defective nozzle (failure or unsatisfactory nozzle) among the plurality of nozzles in the recording head, all the plurality of nozzles in the recording head are used in the scanning of the recording head, and the recording paper is conveyed in the conveyance of the recording paper, only by a length in the sub-scanning direction of an area in which all the plurality of nozzles of the recording head are arranged. On the other hand, in a case that there is an ejection defective nozzle among the plurality of nozzles of the recording head, only normal nozzles (non-ejection defective nozzles) which are included in the plurality of nozzles and which are arranged side by side continuously in the sub-scanning direction are used in the scanning of the recording head, and the recording paper is conveyed in the conveyance of the recording paper, only by a length in the sub-scanning direction of an area in which these normal nozzles are arranged.

SUMMARY

Here, as in the former publicly known ink-jet printer, such a case is considered wherein, in a case that the inspections regarding the presence or absence of any ejection defective nozzle (the inspection regarding the presence of absence of ink eject and the inspection regarding the eject direction) are performed before the recording on the recording paper, and that there is an ejection defective nozzle and the recording on the recording paper is performed after performing the maintenance operation. In such a case, a period of time required for recovering the ejection defective nozzle by the maintenance operation changes or varies depending on a condition such as the number of the ejection defective nozzle, the distribution of the ejection defective nozzle, etc.

As a result, a time since a recording instruction in input and until the recording on the recording paper is completed changes.

On the other hand, as in the latter publicly known ink-jet printer, such a case is considered wherein, in a case that the inspections regarding the presence or absence of any ejection defective nozzle is performed before performing the recording on the recording paper, and that there is any ejection defective nozzle and the recording on the recording paper is performed, without performing the maintenance operation, while reducing the number of nozzles to be used and a conveyance amount of the recording paper. In this case, the number of nozzles which are usable are changed and the number of times of the scanning of the recording head and the number of times of the conveyance of recording paper which are repeated until the completion of the recording change depending on a condition such as the number of the ejection defective nozzle, the distribution of the ejection defective nozzle, etc. As a result, a time since the recording instruction in input and until the recording on the recording paper is completed changes.

Accordingly, in a case that the inspection regarding the absence or presence of ejection defective nozzle is performed before the recording on the recording paper and that there is an ejection defective nozzle, it is irrational to perform the maintenance operation uniformly so as to recover the ejection defective nozzle and then to perform the recording, or to perform the recording while reducing the number of nozzles to be used and reducing the conveyance amount of the recording paper, without considering the time since the recording instruction is input and until the recording on the recording paper is completed.

An object of the present disclosure is to provide a liquid ejection apparatus capable of performing an appropriate operation, in a case that there is an ejection defective nozzle, while considering the time since the recording instruction is input and until ejecting of a liquid onto a medium is completed, and of ejecting a liquid on the medium.

According to an aspect of the present disclosure, there is provided a liquid ejection apparatus including: a head in which a plurality of nozzles are open; a carriage configured to move the head in a scanning direction; a conveyor configured to convey a medium in a conveyance direction crossing the scanning direction; a signal generator configured to output a signal that is selected among a plurality of signals depending on whether or not the plurality of nozzles include an ejection defective nozzle which has defectiveness in ejecting of a liquid; a maintenance part configured to perform a maintenance operation for recovering the ejection defective nozzle; and a controller. The controller is configured to execute: ejecting of the liquid toward the medium by an ejecting operation of performing an ejecting pass of causing the liquid to be ejected from the plurality of nozzles while moving the carriage in the scanning direction and a conveying operation of causing the conveyor to convey the medium. Before the ejecting operation, the controller is configured to execute: determining of whether or not the ejection defective nozzle is present among the plurality of nozzles, based on the signal from the signal generator; and in a case that the controller determines that the ejection defective nozzle is present among the plurality of nozzles, determining, based on a first time and a second time, of whether to perform a first ejecting operation after performing the maintenance operation, or to perform a second ejecting operation without performing the maintenance operation. The first ejecting operation is the ejecting operation in which all the plurality of nozzles are used in the ejecting pass, and the first time is a time required for performing the ejecting of the liquid toward the medium by the first ejecting operation. The second ejecting operation is the ejecting operation in which only nozzles, included in the plurality of nozzles and different from the ejection defective nozzle, are used in the ejecting pass, and the second time is a time required for performing the ejecting of the liquid toward the medium by the second ejecting operation.

According to the present disclosure, it is possible to appropriately determine, based on the first time and the second time, whether to perform the first ejecting operation in which all the plurality of nozzles are usable in the ejecting pass after performing the maintenance operation, or to perform the second ejecting operation in which only a part of the plurality of nozzles is usable in the ejecting pass, without performing the maintenance operation.

DESCRIPTION OF THE EMBODIMENTS

In the following, an embodiment of the present disclosure will be explained.

<Overall Configuration of Printer>

Figure 1:
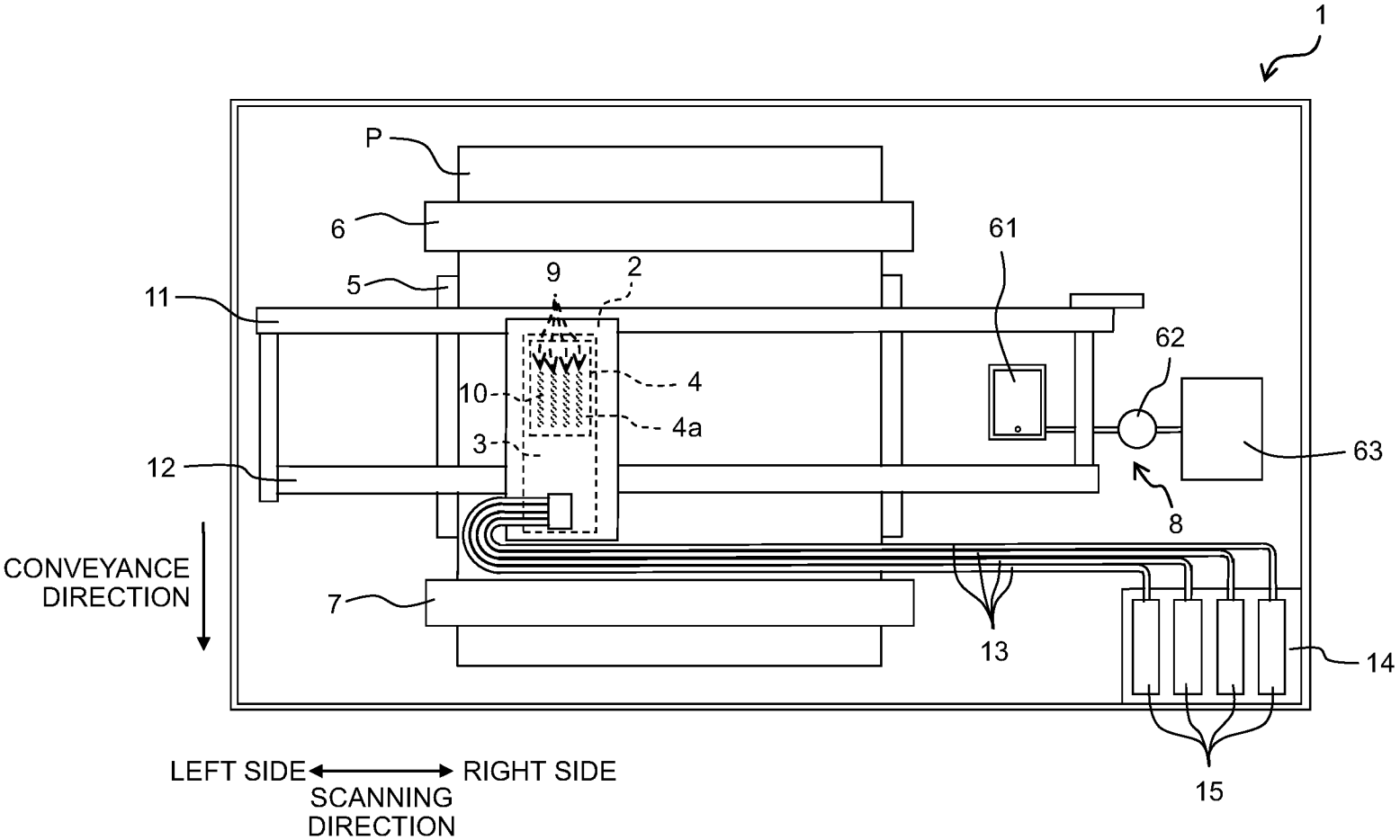
FIG. 1 is a view schematically depicting a configuration of a printer 1.

As depicted in FIG. 1, a printer 1 according to the present embodiment (corresponding to a "liquid ejection apparatus" of the present disclosure) is provided with carriage 2, a sub tank 3, an ink-jet head 4 (corresponding to a "head" of the present disclosure), a platen 5, conveyance rollers 6 and 7 (corresponding to a "conveyor" of the present disclosure), a maintenance unit 8 (corresponding to a "maintenance part" of the present disclosure), etc.

The carriage 2 is supported by two guide rails 11 and 12 extending in a scanning direction. The carriage 2 is connected to a carriage motor 86 (see FIG. 4) via a non-depicted belt, etc. In a case that the carriage motor 86 is driven, the carriage 2 moves in the scanning direction along the guide rails 11 and 12. Note that in the following explanation, the right side and the left side in the scanning direction will be defined as depicted in FIG. 1.

The sub tank 3 is attached to the carriage 3. In this case, a cartridge holder 14 is provided on the printer 1, and four ink cartridges 15 are detachably installed in the cartridge holder 14. Black, yellow, cyan, and magenta inks (each corresponding to a "liquid" of the present disclosure) are stored in the four ink cartridges 15, respectively, in this order from an ink cartridge 15, among the four ink cartridges 15, arranged on the right side in the scanning direction. The sub tank 3 is connected to the four ink cartridges 15 installed in the cartridge holder 14 via four tubes 13, respectively. With this, the four color inks are supplied from the four ink cartridges 15 to the sub tank 3.

The ink-jet head 4 is attached to the carriage 2 and is connected to a lower end part of the sub tank 3. The four color inks are supplied to the ink-jet head 4 from the sub tank 3. Further, the ink-jet head 4 ejects or ejects the inks from a plurality of nozzles 10 formed in a nozzle surface 4*a* which is a lower surface of the ink-jet head 4. To provide more specific explanation, the ink-jet head 4 has four pieces of a nozzle row 9 which are arranged side by side in the scanning direction. Each of the four nozzle rows 9 has nozzles 10 included in the plurality of nozzles 10 and aligned in a conveyance direction which is orthogonal to the scanning direction. The four nozzle rows 9 correspond to the different color inks, respectively. In the present embodiment, the black, yellow, cyan, and magenta inks are ejected in this order from a nozzle row 9 which is included in the four nozzle rows 9 and which is arranged on the right side in the scanning direction.

The platen 5 is arranged at a position below or under the ink-jet head 4 and faces (is opposite to) the plurality of nozzles 10. The platen 5 extends in the scanning direction over the entire length of a recording paper P (corresponding to a "medium" of the present disclosure) and supports the recording paper P from therebelow. The conveyance roller 6 is located on the upstream side in the conveyance direction with respect to the ink-jet head 4 and the platen 5. The conveyance roller 7 is located on the downstream side in the conveyance direction with respect to the ink-jet head 4 and the platen 5. The conveyance rollers 6 and 7 are connected to a conveying motor 87 (see FIG. 4) via non-illustrated gears, etc. In a case that the conveying motor 87 is driven, the conveyance rollers 6 and 7 are rotated so as to convey the recording paper P in the conveyance direction.

The maintenance unit 8 is provided with a cap 61, a suction pump 62 and a waste liquid tank 63. The cap 61 is arranged on the right side in the scanning direction relative to the platen 5. Further, in a case that the carriage 2 is positioned at a maintenance position located on the right side in the scanning direction relative to the platen 5, the plurality of nozzles 10 face (are opposite to) the cap 61.

Further, the cap 61 is capable of being raised and lowered (ascended/descended, moving in the up/down direction) by a cap ascending/descending mechanism 88 (see FIG. 4); in a case that the cap 61 is raised by the cap ascending/descending mechanism 88 in a state that the carriage 2 is positioned at the maintenance position and that the plurality of nozzles 10 are made to face the cap 61, an upper end part of the cap 61 makes tight contact with the nozzle surface 4*a* of the ink-jet head 4 so as to cover the plurality of nozzles 10 with the cap 61. Note that the cap 61 is not limited to or restricted by being a cap which makes tight contact with the nozzle surface 4*a* to thereby cover the plurality of nozzles 10. The cap 61 may be, for example, configured to make tight contact with a non-depicted frame, etc., which is arranged to surround the nozzle surface 4*a* of the ink-jet head 4, to thereby cover the plurality of nozzles 10.

The suction pump 62 is, for example, a tube pump, etc., and is connected to the cap 61 and the waste liquid tank 63. Further, in the maintenance unit 8, in a case that the suction pump 62 is driven in a state that the plurality of nozzles 10 are covered by the cap 61 as described above, it is possible to perform a so-called suction purge (corresponding to a "maintenance operation" of the present disclosure) wherein the ink inside the ink-jet head 4 is discharged from the plurality of nozzles 10. The ink discharged by the suction purge is stored in the waste liquid tank 63.

Further, in the present embodiment, control performed by a controller 80 (to be described later on) makes it possible for the maintenance unit 8 to selectively perform any one of a plurality of kinds of suction purges which are different from each other in a driving time (driving period of time) of the suction pump 62. Furthermore, in the plurality of kinds of suction purges, as the driving time of the suction pump 62 in a suction purge is longer, a discharge amount of the ink from the nozzle 10 is greater. Note that in the present embodiment, a time required for the operation is different among the plurality of kinds of suction purges due to the difference in the driving time of the suction pump 62.

Note that the explanation has been made, for the sake of convenience, about a case that the cap 61 covers all the plurality of nozzles 10 in a collective manner, and that in the suction purge, the ink inside the ink-jet head 4 is discharged from all the plurality of nozzles 10. However, the present disclosure is not limited to such a configuration. For example, it is also allowable that the cap 61 is provided with a part covering nozzles 10 which are included in the plurality of nozzles 10 and which construct the rightmost nozzle row 9 ejecting the black ink, and another part separate from the part and covering nozzles 10 which are included in the plurality of nozzles 10 and which construct the remaining left-side three nozzle rows 9 ejecting color inks (yellow, cyan and magenta ink), respectively. Further, it is also allowable that in the suction purge, either one of the black ink and the color inks in the ink-jet head 4 is/are selectively discharged. Alternatively, it is also allowable that the cap 61 is provided individually on each of the nozzle rows 9. Further, in the suction purge, it is allowable that the ink is discharged from the nozzles 10 individually from each of the nozzle rows 9.

Figure 2:
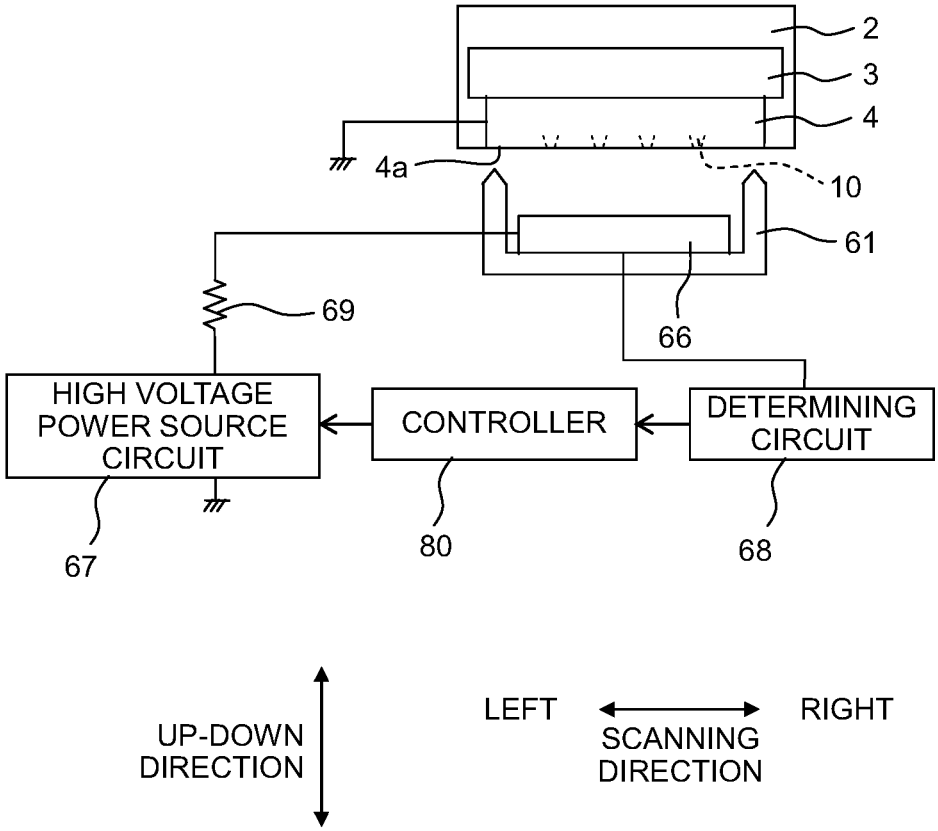
FIG. 2 is a view depicting a detecting electrode arranged inside a cap, and explaining the relationship of connection of the detecting electrode to a high voltage power source circuit and to a determining circuit.

Further, as depicted in FIG. 2, a detecting electrode 66 having a rectangular shape in a plane view is arranged inside the cap 61. The detecting electrode 66 is connected to a high voltage power source circuit 67 via a resistor 69. Further, a predetermined positive potential (for example, approximately 300 V) is imparted to the detecting electrode 66 by the high voltage power source circuit 67. On the other hand, the ink-jet head 4 is maintained at the ground potential. With this, there is generated a predetermined difference in the potential between the ink-jet head 4 and the detecting electrode 66. A determining circuit 68 is connected to the detecting electrode 66. The determining circuit 68 compares the voltage value of a voltage signal outputted from the detecting electrode 66 with a threshold value Vt, and outputs a signal according to the result of the comparison.

Figure 3A:
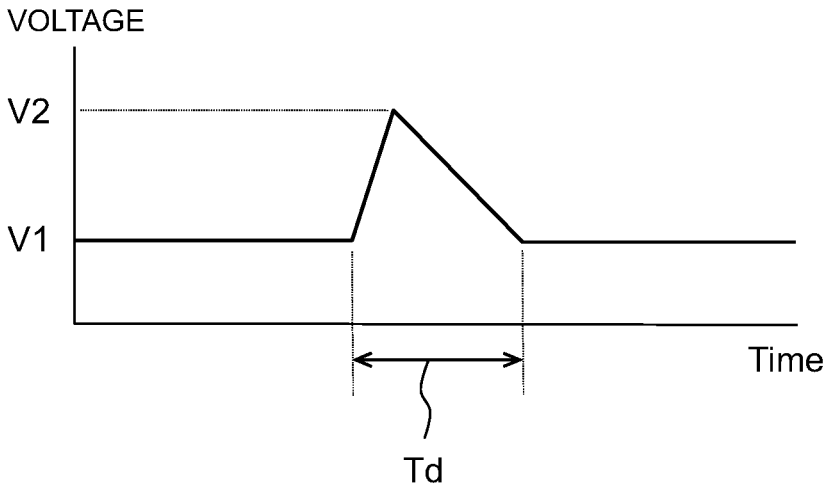
FIG. 3A is a view depicting a change in a voltage value of the detecting electrode in a case that ink is ejected from a nozzle.

To provide a more specific explanation, since the difference in the potential is generated between the ink-jet head 4 and the detecting electrode 66, the ink ejected from the nozzles 10 is charged with the electricity. In a case that the ink or inks is/are ejected from the nozzles 10 toward the detecting electrode 66 in a state that the carriage 2 is positioned at the above-described maintenance position, the charged ink approaches closely to the detecting electrode 66. In this situation, as depicted in FIG. 3A, until the charged ink lands on the detecting electrode 66, the voltage value of the detecting electrode 66 is raised from a voltage value V1 in a state that the ink-jet head 4 is not driven, and the voltage value reaches a voltage value V2 which is higher than voltage value V1. Then, after the charged ink has landed on the detecting electrode 66, the voltage value of the detecting electrode 66 is lowered gradually and returns to be the voltage value V1. Namely, in a driving time Td during which the ink-jet head 4 is driven, the voltage value of the detecting electrode 66 changes.

Figure 3B:
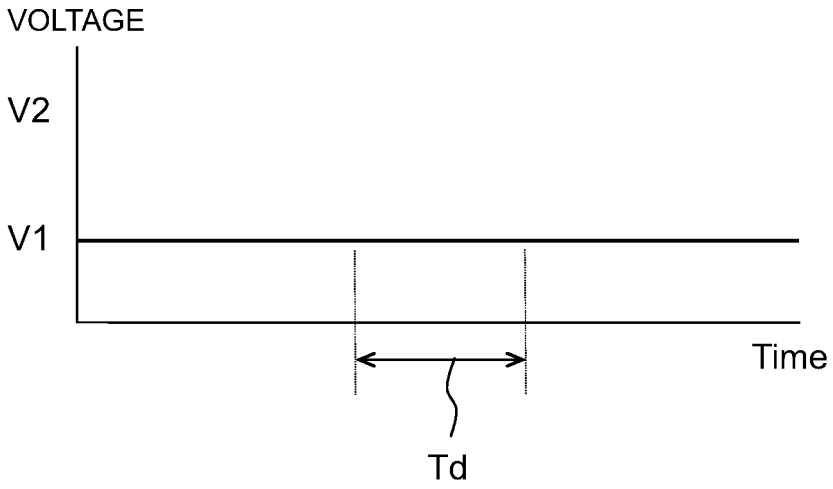
FIG. 3B is a view depicting the change in the voltage value of the detecting electrode in a case that the ink is not ejected from the nozzle.

On the other hand, in a case that the ink is not ejected from the nozzles 10, the voltage value of the detecting electrode 66 hardly changes from the voltage value V1 during the driving time Td of the ink-jet head 4, as depicted in FIG. 3B. In view of this, a threshold value Vt ($V1<Vt<V2$) is set in the determining circuit 68 so as to discriminate or distinguish these voltage values in the above two cases. Further, the determining circuit 68 compares a maximum voltage value of the voltage signal outputted from the detecting electrode 66 and the threshold value Vt during the driving time Td of the ink-jet head 4, and outputs a signal in accordance with the result of the determination. Note that in the present embodiment, the detecting electrode 66, the high voltage power source circuit 67, the resistor 69 and the determining circuit 68 are combined to collectively correspond to a "signal generator" of the present disclosure. Further, the signal generator outputs different signals from the determining circuit 68 depending on whether or not the nozzle 10 is an ejection defective nozzle from which the ink is not ejected.

Further, in this case, although the positive potential is imparted to the detecting electrode 66 by the high voltage power source circuit 67, it is also allowable that a negative potential (for example, approximately −300 V) is imparted to the detecting electrode 66 by the high voltage power source circuit 67. Also in this case, in a case that the ink or inks is (are) ejected from the nozzles 10 toward the detecting electrode 66 in the state that the carriage 2 is positioned at the above-described maintenance position, the charged ink approaches closely to the detecting electrode 66. In this situation, conversely to the above-described case, until the charged ink lands on the detecting electrode 66, the voltage value of the detecting electrode 66 is lowered from the voltage value V1, and the voltage value of the detecting electrode 66 is gradually raised and returns to the voltage value V1 after the ink has landed on the detecting voltage 66.

<Electrical Configuration of Printer>

Figure 4:
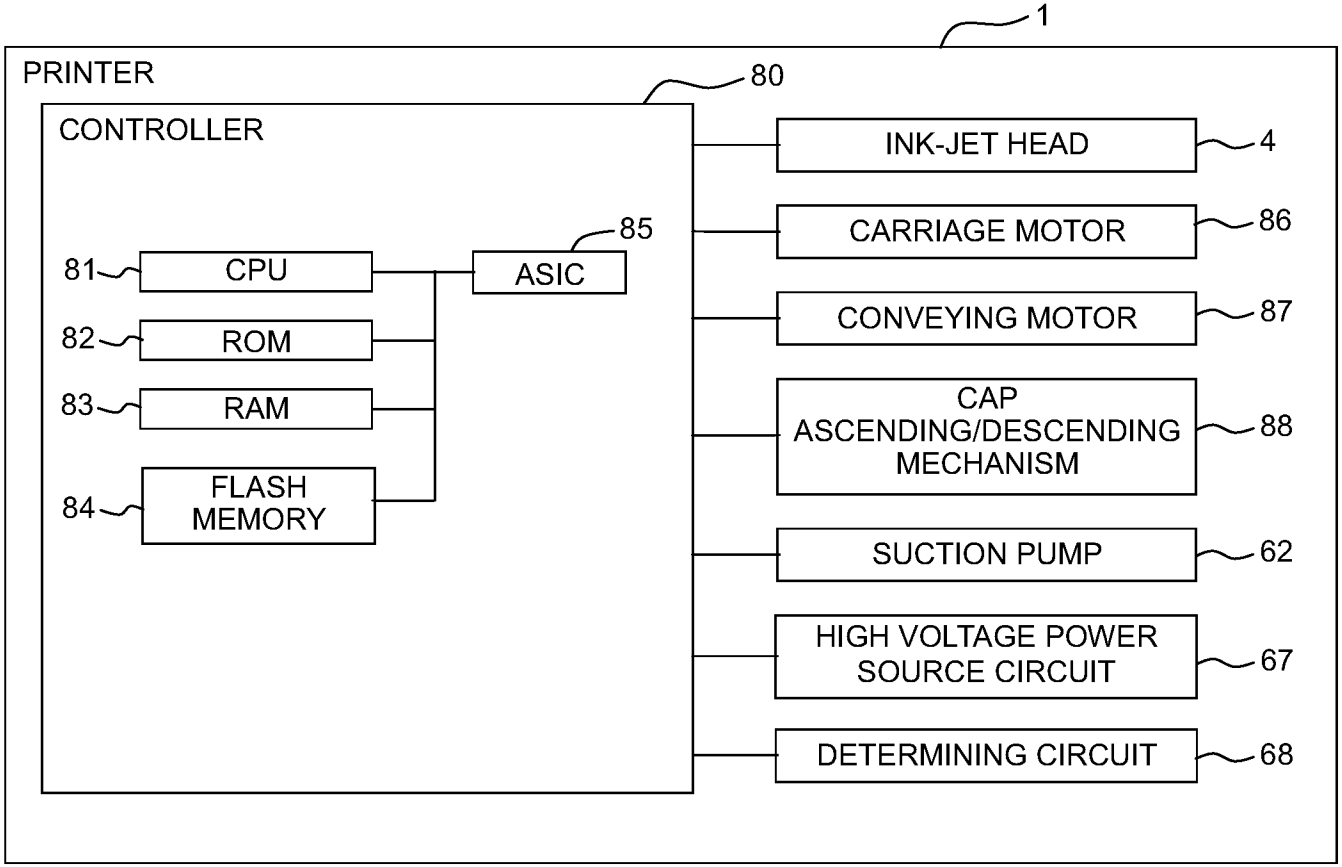
FIG. 4 is a block diagram depicting the electrical configuration of the printer 1.

Next, an explanation will be given about the electrical configuration of the printer 1. The operation of the printer 1 is controlled by a controller 80. As depicted in FIG. 4, the controller 80 includes a CPU (Central Processing Unit) 81, a ROM (Read Only Memory) 82, a RAM (Random Access Memory) 83, a flash memory 84, an ASIC (Application Specific Integrated Circuit) 85, etc., and these components or elements control the operations of the ink-jet head 4, the carriage motor 86, the conveying motor 87, the cap ascending/descending mechanism 88, the high voltage power source circuit 67, the suction pump 62, etc.

Further, the signal from the determining circuit 68 is input to the controller 80. With this, information whether or not the nozzle 10 is an ejection defective nozzle, based on the signal from the determining circuit 68, is input to the controller 80.

Note that in the controller 80, it is allowable that only the CPU 81 performs the respective processings. Alternatively, it is allowable that only the ASIC 85 performs the respective processings, or that the CPU 81 and the ASIC 85 perform the respective processings in a cooperative manner. Still alternatively, in the controller 80, it is allowable that one CPU singly performs the respective processing, or that a plurality of pieces of the CPU 81 perform the processings in a sharing manner. Alternatively, in the controller 80, it is allowable that one ASIC 85 singly performs the respective processing, or that a plurality of pieces of the ASIC 85 perform the processings in a sharing manner.

<Control During Recording>

Next, an explanation will be given about a processing performed in the printer 1 in a case of recording an image on a recording paper P. In the printer 1, the controller 80 records an image on a recording paper P by a recording operation (corresponding to a "ejecting operation" of the present disclosure) wherein a recording pass (corresponding to a "ejecting pass" of the present disclosure) and a conveying operation are alternately repeated. In the recording pass, the controller 80 controls the ink-jet head 4 to eject the ink(s) from the plurality of nozzles 10 while controlling the carriage motor 86 to move the carriage 2 in the scanning direction. In the conveying operation, the controller 80 controls the conveying motor 87 to cause the conveying rollers 6 and 7 to convey the recording paper P in the conveyance direction.

Figure 5A:
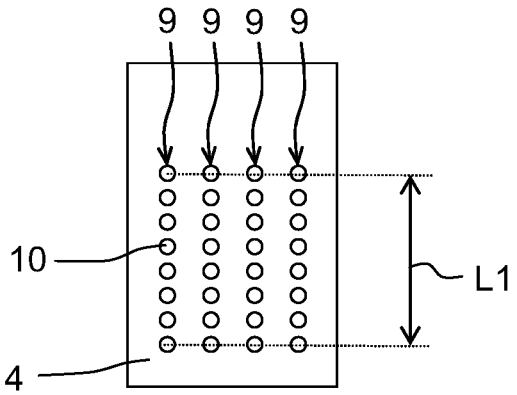
FIG. 5A is a view for explaining nozzles usable in a first recording operation.
Figure 5B:
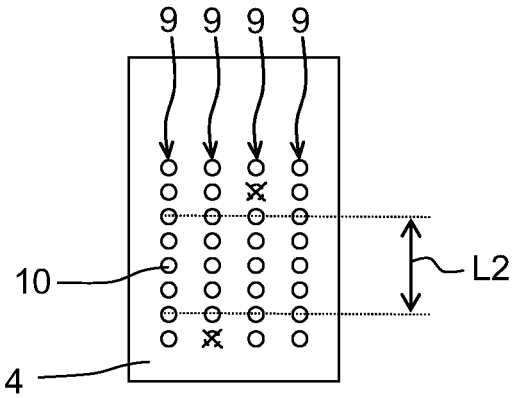
FIG. 5B is a view for explaining nozzles usable in a second recording operation.

Further, the printer 1 is capable of selectively performing, as the recording operation, either one of a first recording operation (corresponding to a "first ejecting operation" of the present disclosure) and a second recording operation (corresponding to a "second ejecting operation" of the present disclosure). In the first recording operation, as depicted in FIG. 5A, all the plurality of nozzles 10 in the ink jet head 4 are usable in the recording pass. In the second recording operation, for example as depicted in FIG. 5B, only nozzles 10, which are included in the plurality of nozzles 10 in the ink-jet head 4, which are arranged continuously side by side in the conveyance direction and each of which is not the ejection defective nozzle are usable in the recording pass. Here, FIGS. 5A and 5B depict usable nozzles 10 in solid lines. Further, FIG. 5B depicts nozzles 10 to each of which "x" is added as ejection defective nozzles.

Furthermore, in the second recording operation, all dots of an image (eject of the liquid), including a dot or dots (eject of the liquid) allocated to the ejection defective nozzle or nozzles 10 among a plurality of nozzles 10 constructing a certain nozzle row 9 among the nozzle rows 9, are allocated to nozzles 10 included in the plurality of nozzles 10 constructing the same certain nozzle row 9 and different from the ejection defective nozzle(s) 10. Moreover, in the first recording operation, as depicted in FIG. 5A, the usable nozzles 10 are arranged in the conveyance direction over a range of a length L1. In contrast, in the second recording operation, as depicted in FIG. 5B, the usable nozzles 10 are arranged in the conveyance direction over a range of a length L2 which is shorter than the length L1. Accordingly, in the second recording operation, a length in the conveyance direction of a region which is recorded by one time of the recording pass is shorter than that in the first recording operation, and a conveyance amount of the recording paper P in the conveying operation is smaller than that in the first recording operation. Accordingly, in the second recording operation, the number of times of the recording pass and the number of times of the conveying operation which are required for performing recording on the recording paper P are greater than those in the first recording operation.

Further, the printer 1 is capable of recording an image selectively on either one of a first recording paper (corresponding to a "first medium" of the present disclosure) and a second recording paper (corresponding to a "second medium" of the present disclosure) of which size is smaller than that of the first recording paper. Here, the first recording paper is, for example, regular paper such as A4-sized paper, B5-sized paper, etc., and the second recording paper is, for example, a postcard.

Furthermore, the printer 1 is capable of recording of an image selectively by either one of a normal recording mode (corresponding to a "first eject mode" of the present disclosure) and a high resolution recording mode (corresponding to a "second eject mode" of the present disclosure) in which the ink is caused to be ejected from the plurality of nozzles 10 so that dots constructing the image are formed at a resolution which is higher than that in the normal recording mode.

Figure 6A:
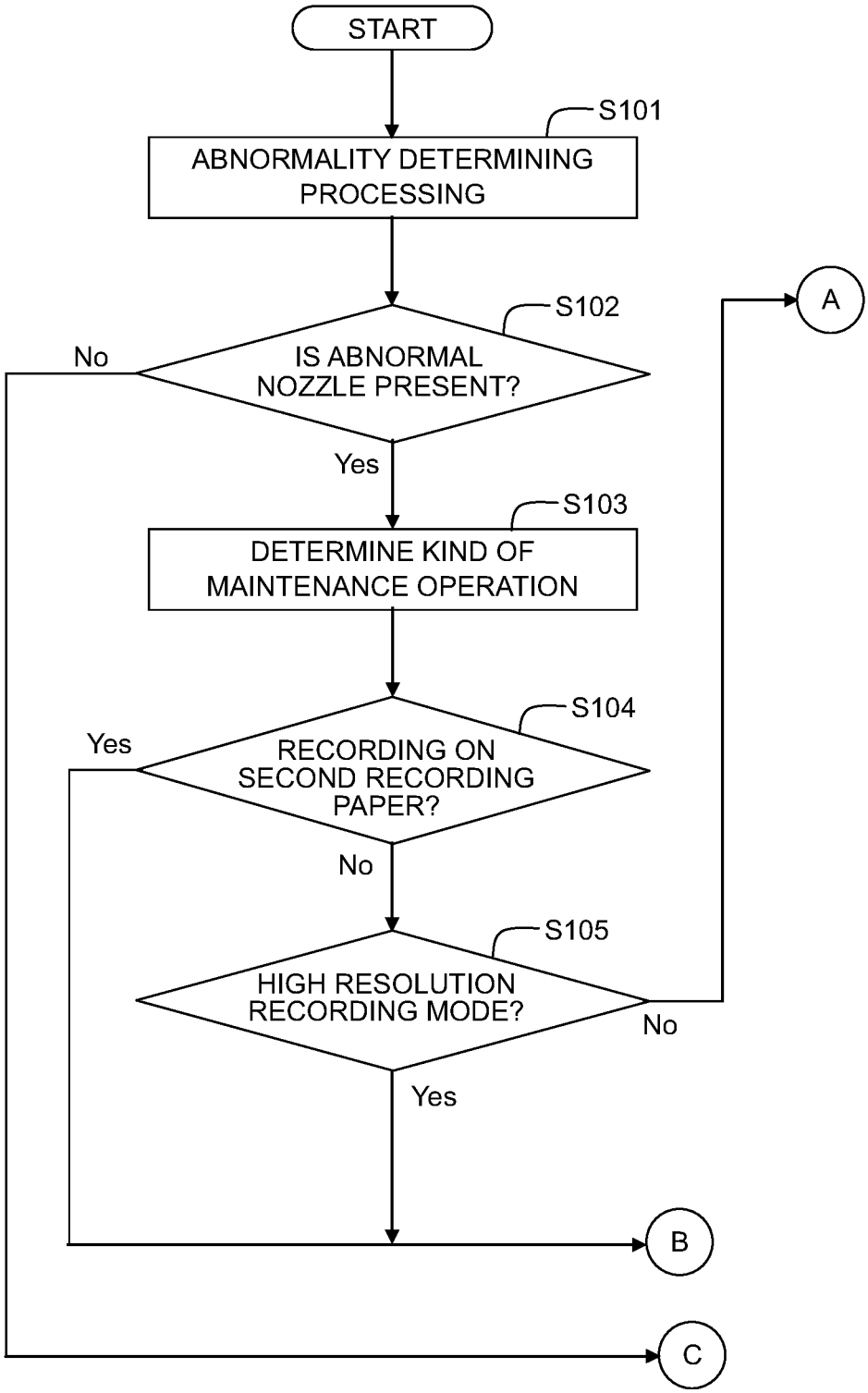
FIGS. 6A and 6B depict a flow chart depicting the flow of a processing in a case that a recording instruction is input.
Figure 6B:
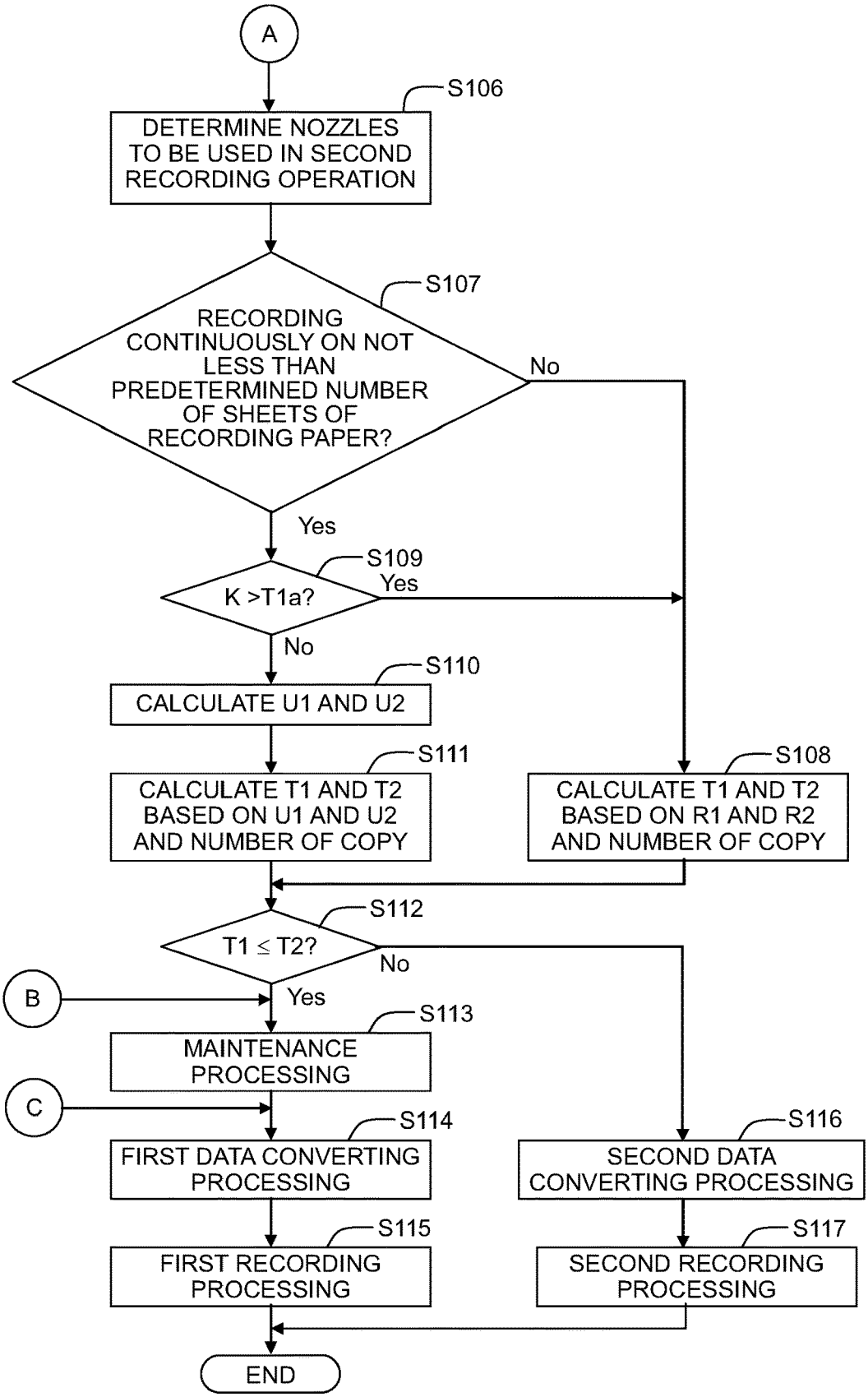

Moreover, in a case that the recording is performed on the recording paper P in the printer 1, the controller 80 performs the processing in accordance with the flow depicted in FIGS. 6A and 6B. The flow of FIG. 6A is started in a case that a recording instruction (recording command) to instruct the recording of an image on the recording paper P is input to the printer 1.

As depicted in FIGS. 6A and 6B, in a case that the recording instruction is input, the controller 80 firstly execute an defectiveness determining processing (step S101). In the defectiveness determining processing, the controller 80 drives the ink-jet head 4, in a state that the carriage 2 is positioned at the maintenance position, so as to make each of the plurality of nozzles 10 of the ink-jet head 4 to eject the ink toward the detecting electrode 66; based on a signal outputted from the determining circuit 68 at this time, the controller 80 performs the defectiveness determining processing of determining whether or not each of the plurality of nozzles 10 is an ejection defective nozzle.

Subsequently, the controller 80 determines whether or not there is any ejection defective nozzle among the plurality of nozzles 10 of the ink-jet head 4, based on the result of the defectiveness determining processing in step S101 (step S102). In a case that there is not any ejection defective nozzle (step S102: NO), the controller 80 proceeds to the processing of step S114 (to be described later on). In a case that there is an ejection defective nozzle (step S102: YES), the controller 80 determines the kind of the maintenance operation, based on the result of the defectiveness determining processing in step S101 (step S103).

In the processing of step S103, the controller 80 determines which one of the plurality of kinds of suction purges is to be performed, as the maintenance operation, based on the number of the ejection defective nozzle, the distribution of the ejection defective nozzle, etc. For example, as the number of ejection defective nozzle is greater, the controller 80 determines the maintenance operation to be the kind of the suction purge to such a kind of driving purge wherein the driving time of the suction pump 62 is greater (the discharge amount of the ink is greater). Alternatively, for example, as the ratio of the ejection defective nozzles located at the both ends in the conveyance direction is greater, the controller determines the kind of the suction purge to such a kind of suction purge wherein the driving time of the suction pump 62 is greater (the discharge amount of the ink is greater).

Subsequently, in a case that the recording is to be performed on the second recording paper (step S104: YES) and in a case that the recording is to be performed by the high resolution recording mode (step S104: YES, step S105: YES), the controller 80 proceeds to the processing of step S113 (to be described later on).

On the other hand, in a case that the recording is to be performed on the first recording paper (step S104: NO) and in a case that the recording is to be performed by the normal recording mode (step S105: NO), the controller 80 then determines nozzles 20 to be used in a case of performing the recording in the second recording mode, based on a position in the conveyance direction of the ejection defective nozzle indicated by the result of the defectiveness determining processing in step S101 (step S106).

Subsequently, the controller 80 determines whether or not an image corresponding to a same image data is to be recorded continuously on not less than a predetermined number of sheets of the recording paper P (corresponding to a "recording repeatedly on not less than a predetermined number of times" of the present disclosure) (step S107). In this situation, it is allowable to record the image corresponding to the image data on one sheet of the recording paper P, or to record the image corresponding to the image data on a plurality of sheets of the recording paper P. Note that in the following, the "image corresponding to the same image data" is referred simply to as a "same image", in some cases.

In a case that the image is to be recorded only one sheet of the recording paper (corresponding to a "perform(s) recording . . . only one time" of the present disclosure), and in a case the same image is to be recorded continuously on less than the predetermined number of sheets of the recording paper P (corresponding to a "perform(s) recording repeatedly a number of times which is less than a predetermined number of times" of the present disclosure) (step S107: NO), the controller 80 calculates a first time T1 and a second time T2 based on a first reference recording time R1 (corresponding to "first reference time information" of the present disclosure), a second reference recording time R2 (corresponding to "second reference time information" of the present disclosure) and a number of sheet of the recording paper P for which the recording is to be performed (number of recorded copy) (step S108), and proceeds to the processing of step S112 (to be described later on).

Here, the first reference recording time R1 is an assumed value of a time which is obtained in advance by an experiment, etc., and which is required for performing recording of the image on one sheet of the recording paper P (corresponding to the "recording the image one time" of the present disclosure) by the first recording operation. The second reference recording time R2 is an assumed value of a time which is obtained by an experiment, etc., in advance and which is required for performing recording of the image on one sheet of the recording paper P (corresponding to the "recording the image one time" of the present disclosure) by the second recording operation. The first reference recording time R1 and the second reference recording time R2 are stored in advance in the flash memory 84 (corresponding to a "memory" of the present disclosure) for example at a time of production of the printer 1, etc.

Further, the first time T1 is a time required for performing the recording of the image on all of the recording paper P for which the recording is instructed by the first recording operation, after performing the maintenance operation. Furthermore, the second time T2 is a time required for performing the recording of the image on all of the recording paper P for which the recording is instructed by the second recording operation, without performing the maintenance operation.

In the processing of step S108, the controller 80 calculates, as the first time T1, a time obtained by adding, to a time obtained by multiplying the first reference recording time R1 by the number of recorded copy, the time required for performing the maintenance operation which is determined in the processing of step S103. Further, the controller 80 calculates, as the second time T2, a time obtained by multiplying the second reference recording time R2 by the number of recorded copy. Note that the information regarding the time required for performing each of the plurality of kinds of suction purges, as the maintenance operation, is stored in the flash memory 84 in advance.

On the other hand, in a case that the same image is to be recorded continuously on not less than a predetermined number of sheets of the recording paper P (step S107: YES), the controller 80 subsequently analyzes the image data input thereto together with the recording instruction, and determines whether or not a calculating time K, which is required for calculating a first recording time U1 required for recording the image on one sheet of the recording paper P by the first recording operation and a second recording time U2 required for recording the image on one sheet of the recording paper P by the second recording operation, is longer than a time T1*a* which is calculated as the first time T1 in a similar manner as in the processing of step S108 described above (step S109). Note that in the present embodiment, a condition that the calculating time K is longer than the time T1*a* corresponds to a "predetermined condition" of the present disclosure.

In a case that the calculating time K is longer than the time T1*a* (step S109: YES), the controller 80 calculates the first time T1 and the second time T2 based on the first reference recording time R1, the second reference recording time R2 and the number of recorded copy, in a similar manner as described above (step S108), and proceeds to the processing of step S112.

In a case that the calculating time K is not more than the time T1*a* (step S109: NO), the controller 80 calculates the first recording time U1 and the second recording time U2 based on the image data (step S110), and calculates the first time T1 and the second time T2 based on the first recording time U1 and the second recording time US and the number of recorded copy (step S111), and proceeds to the processing of step S112. In the processing of step S111, the controller 80 calculates, for example, a time obtained by adding, to a time obtained by multiplying the first recording time U1 by the number of recorded copy, the time required for performing the maintenance operation which is determined in step S103, as the first time T1. Further, the controller 80 calculates a time obtained by multiplying the second recording time U2 by the number of recorded copy, as the second time T2.

In the processing of step S112, the controller 80 determines whether or not the first time T1 calculated in the processing of step S108 or the processing of step S111 is not more than the second time T2. In a case that the first time T1 is not more than the second time T2 (step S112: YES), the controller 80 executes a maintenance processing of performing the maintenance operation determined in the processing of step S103 (step S113).

Subsequently, the controller 80 executes a first data converting processing (step S114). Here, the image data input to the controller 80 together with the recording instruction is three-color data of R (Red), G (Green) and B (Blue). In the first data converting processing, the controller 80 performs color conversion of the image data of RGB to a four-color data (Black, Yellow, Cyan and Magenta) which can be ejected from the ink-jet head 4. Further, in the first data converting processing, the controller 80 allocates the respective dots of the image in the four-color data as described above to the nozzles 10 which are usable in the first recording processing (all of the plurality of nozzles 10 in the ink-jet head 4). With this, the image data is converted to ejectedata, for ejecting in the first recording operation the inks from the plurality of nozzles 10 of the ink-jet head 4, in which each of the plurality of nozzles 10 is allocated to one of the dots with respect to the four color inks.

Subsequently, the controller 80 executes a first recording processing of performing the first recording operation (step S115). In the first recording processing in step S115, the controller 80 causes the inks to be ejected from the plurality of nozzles 10 of the ink-jet head 4 toward the recording paper P in the recording pass of the first recording operation, based on the ejectedata obtained in the processing of step S114.

In a case that the first time T1 is longer than the second time T2 (step S112: NO), the controller 80 subsequently executes a second data converting processing (step S116). In the second converting processing, the controller 80 performs color conversion of the three-color image data of RGB to a four-color data which can be ejected from the ink-jet head 4. Further, in the second data converting processing, the controller 80 allocates the respective dots of the image in the four-color data as described above to the nozzles 10 which are usable in the second recording processing (nozzles 10 each of which is not an ejection defective nozzle). With this, the image data is converted to ejectedata, for ejecting in the second recording operation the inks from the nozzles 10 of the ink-jet head 4, in which each of the nozzles 10 is allocated to one of the dots with respect to the four color inks.

Subsequently, the controller 80 executes a second recording processing of performing the second recording operation (step S117). In the second recording processing in step S117, the controller 80 causes the inks to be ejected from the nozzles 10 of the ink-jet head 4 toward the recording paper P in the recording pass of the second recording operation, based on the ejectedata obtained in the processing of step S116.

Note that in the present embodiment, in a case that the first time T1 and the second time T2 are same, the controller 80 executes the maintenance processing, the first data converting processing and the first recording processing. However, the aspect of present disclosure is not limited to or restricted by this. In the case that the first time T1 and the second time T2 are same, the controller 80 may execute the second data converting processing and the second recording processing.

Effects of Embodiment

In the case that the controller 80 determines that there is an ejection defective nozzle, the controller 80 is capable of performing the maintenance operation to thereby make it possible that all the plurality of nozzles 10 of the ink-jet head 4 are in the usable state. Then, the controller 80 is capable of performing the first recording operation in which all the plurality of nozzle 10 of the ink-jet head 4 are usable in the recording pass, thereby making it possible to record an image with respect to the recording paper P. Further, in the case that the controller 80 determines that there is an ejection defective nozzle, the controller 80 does not perform the maintenance operation, but performs the second recording operation in which only nozzles 10, which are included in the plurality of nozzles 10 in the ink-jet head 4, and each of which is not the ejection defective nozzle are usable in the recording pass, thereby making it possible to record an image with respect to the recording paper P.

On the other hand, in the present embodiment, since the kind of the maintenance operation to be performed is changed depending on the condition such as the number of the ejection defective nozzle, the distribution of the ejection defective nozzle, etc. Accordingly, the time required for performing the maintenance operation and then performing the first recording operation to thereby perform recording on the recording paper P changes depending on the condition such as the number of the ejection defective nozzle, the distribution of the ejection defective nozzle, etc. Therefore, the time taken to perform the maintenance operation and then to perform the first recording operation to thereby perform recording on the recording paper P changes depending on the condition such as the number of the ejection defective nozzle, the distribution of the ejection defective nozzle, etc.

Further, in the second recording operation, the number of the usable nozzles 10 is smaller than that in the first recording pass, and the conveyance amount of the recording paper P in the conveyance operation is smaller than that in the first recording operation. Accordingly, the number of times of the recording pass required for performing recording of an image on the recording paper P is great, and the time required for performing recording of the image on the recording paper P is longer than that in the first recording operation. Further, since the number of the nozzles 10 which are usable in the second recording operation changes depending on the condition such as the number of the ejection defective nozzle, the distribution of the ejection defective nozzle, etc. Accordingly, the time required for performing the second recording operation to thereby performing recording on the recording paper P changes depending on the condition such as the number of the ejection defective nozzle, the distribution of the ejection defective nozzle, etc.

Thus, in the case that there is an ejection defective nozzle, whether in which one of the following two cases the time since the recording instruction is input and until the recording of the image on the recording paper P is completed is shorter is changed depending on the condition such as the number of the ejection defective nozzle, the distribution of the ejection defective nozzle, etc., the former of the two cases being the case of performing the maintenance operation and then performing the recording of the image on the recording paper P by the first recording operation, and the latter of the two cases being the case of performing the recording of the image on the recording paper P by the second recording operation without performing the maintenance operation.

In view of the above-described situation, in the present embodiment, the controller 80 calculates the first time T1 and the second time T2. The first time T1 is the time required for performing the recording of the image on all of the recording paper P, for which the recording is instructed, by the first recording operation after performing the maintenance operation. The second time T2 is the time required for performing the recording of the image on all of the recording paper P, for which the recording is instructed, by the second recording operation, without performing the maintenance operation. Further, based on the first time T1 and the second time T2, the controller 80 determines whether the image is to be recorded on the recoding paper P by performing the first recording operation after performing the maintenance operation, or the image is to be recorded on the recoding paper P by performing the second recording operation without performing the maintenance operation. Specifically, in a case that the first time T1 is not more than the second time T2, the controller 80 records the image on the recording paper P by performing the first recording operation after performing the maintenance operation. Alternatively, in a case that the second time T2 is shorter than the first time T1, the controller 80 records the image on the recording paper P by performing the second recording operation without performing the maintenance operation. With this, in the case that there is an ejection defective nozzle, it is possible to make the time since the recording instruction is input and until the recording of the image on all of the recording paper P for which the recording is instructed is completed to be as short as possible.

Further, in the present embodiment, the printer 1 is capable of selective performing, as the maintenance operation, any one of the plurality of kinds of suction purges which are different from each other in the required time (driving time or driving period of time of the suction pump 62). Corresponding to this, in the present embodiment, the controller 80 determines of which one of the maintenance operations is to be performed based on the number of the ejection defective nozzle, the distribution of the ejection defective nozzle, etc., and determines, based on the first time T1 and the second time T2 in a case of performing the determined maintenance operation, whether the first recording operation is to be performed after performing the maintenance operation, or whether the second recording operation is to be performed without performing the maintenance operation. With this, in the case that there is an ejection defective nozzle, it is possible to make the time since the recording instruction is input and until the recording of the image on all of the recording paper P for which the recording is instructed is completed to be as short as possible.

Further, in the present embodiment, in a case that the controller 80 calculates the first recording time U1 based on the image data and calculates the first time T1 based on the first recording time U1, the controller 80 is capable of calculating the first time T1 more precisely than in another case of calculating the first time T1 based on the first reference recording time R1 which is previously stored. Similarly, in a case that the controller 80 calculates the second recording time U2 based on the image data and calculates the second time T2 based on the second recording time U2, the controller 80 is capable of calculating the second time T2 more precisely than in another case of calculating the second time T2 based on the second reference recording time R2 which is previously stored.

On the other hand, a time to some extent is required for calculating the first recording time U1 and the second recording time U2 based on the image data. Further, as the number of times the recording of an image corresponding to same image data is repeatedly performed is greater, the difference between the first time T1 calculated based on the first recording time U1 and the first time T1 calculated based on the first reference recording time R1, and the difference between the second time T2 calculated based on the second recording time U2 and the second time T2 calculated based on the second reference recording time R2 become greater. Furthermore, the time required for recording of the image on all of the recording paper P, for which the recording is instructed, becomes longer, as well.

In view of this, in a case that the image is to be recorded only one sheet of the recording paper and in a case that the same image is to be recorded continuously on less than the predetermined number of sheets of the recording paper P, the controller 80 calculates the first time T1 based on the first reference recording time R1 and the number of recorded copy of the image, and calculates the second time T2 based on the second reference recording time R2 and the number of recorded copy of the image. With this, in a case that the time required for recording of the image on all of the recording paper P, for which the recording is instructed is short, it is possible to make the time required for calculating the first time T1 and the second time T2 not to be long.

On the other hand, in a case that the same image is to be recorded continuously on not less than the predetermined number of sheets of the recording paper P, the controller 80 calculates the first recording time U1 and the second recording time U2 based on the image data. Further, the controller 80 calculates the first time T1 based on the first recording time U1 and the number of recorded copy of the image, and calculates the second time T2 based on the second recording time U2 and the number of recorded copy of the image. With this, the first time T1 and the second time T2 which are calculated become precise, which in turn makes it possible to appropriately determine whether the first ejecting operation is to be performed after performing the maintenance operation, or whether the second ejecting operation is to be performed without performing the maintenance operation.

Note, however, that even in the case of recording the same image continuously on not less than the predetermined number of sheets of the recording paper P, there is such a case that the time required for calculating the first recording time U1 and the second recording time U2 based on the image data is too long. In such a case, if the controller 80 calculates the first time T1 based on the first recording time U1 and calculates the second time T2 based on the second recording time U2, then the time since the recording instruction is input and until recording of the image on all of the recording paper P for which the recording is instructed is completed is made to be rather long, in some cases. In view of this situation, in the present embodiment, in a case that the time required for calculating the first recording time U1 and the second recording time U2 based on the image data is longer than the time T1*a* which is the first time T1 calculated based on the first reference recording time R1 and the number of recorded copy of the image, then even in the case that the controller 80 records the same image continuously on not less than the predetermined number of sheets of the recording paper P, the controller 80 calculates the first time T1 based on the first reference recording time R1 and the number of recorded copy of the image, and calculates the second time T2 based on the second reference recording time R2 and the number of recorded copy of the image. With this, it is possible to make the time required for calculating the first time T1 and the second time T2 to be not too long.

Further, in the present embodiment, in a case of performing the recording by the high resolution recording mode in which resolution is high, the time required for the second recording operation becomes to be greatly longer with respect to the time required for the first recording operation, as compared with that in a case of performing the recording by the normal recording mode in which the resolution is lower than that in the high resolution recording mode. Accordingly, there is a high possibility that the time required for recording the image by performing the second recording operation without performing the maintenance operation might become long with respect to the time required for recording the image by performing the first recording operation after performing the maintenance operation.

In view of the above-described situation, in a case that the recording is to be performed by the normal recording mode in which the resolution is low and that the controller 80 determines in the defectiveness determining processing that there is an ejection defective nozzle among the plurality of nozzles 10, the controller 80 determines, based on the first time T1 and the second time T2, whether the image is to be recorded by performing the first recording operation after performing the maintenance operation, or whether the image is to be recorded by performing the second recording operation without performing the maintenance operation.

On the other hand, in a case that the recording is to be performed by the high resolution recording mode in which the resolution is high and that the controller 80 determines in the defectiveness determining processing that there is an ejection defective nozzle among the plurality of nozzles 10, the controller 80 performs the recording of the image by performing the first recording operation after performing the maintenance operation.

Further, in a case that the recording paper P is the second recording paper of which size is small, then if the image is recorded by performing the first recording operation after performing the maintenance operation, the time required therefor is not much long. In view of this situation, in a case that the recording is to be performed on the first recording paper of which size is great and that the controller 80 determines in the defectiveness determining processing that there is an ejection defective nozzle among the plurality of nozzles 10, the controller 80 determines, based on the first time T1 and the second time T2, whether the recording is to be performed by performing the first recording operation after performing the maintenance operation, or whether the recording is to be performed by performing the second recording operation without performing the maintenance operation. On the other hand, in a case that the recording is to be performed on the second recording paper of which size is small and that the controller 80 determines in the defectiveness determining processing that there is an ejection defective nozzle among the plurality of nozzles 10, the controller 80 performs the recording by performing the first recording operation after performing the maintenance operation. With this, it is possible to make the processing to be simple in a case that the size of the recording paper P is small.

Furthermore, the controller 80 allocates, in the second recording operation, all dots of the image (eject of the liquid), including dot(s) (eject of the liquid) allocated to the ejection defective nozzle(s) 10 among the plurality of nozzles 10 constructing a certain nozzle row 9 among the nozzle rows 9, to nozzle(s) 10 included in the plurality of nozzles 10 constructing the same certain nozzle row 9 and different from the ejection defective nozzle(s) 10. Moreover, in accordance with this allocation, the controller 80 makes the conveyance amount of the recording paper P in the conveying operation to be smaller than that in the first recording operation. Accordingly, it is possible to recording the image on the recording paper P by using only the nozzles 10 each of which is not the ejection defective nozzle.

<Modification>

In the foregoing, the embodiment of the present disclosure has been explained. The present disclosure, however, is not limited to or restricted by the above-described embodiment; it is allowable to make a various kind of changes to the present disclosure, within the scope described in the claims.

In the above-described embodiment, in a case that there is an ejection defective nozzle and that the image is to be recorded on the first recording paper of which size is large, the controller 80 determines, based on the magnitude relationship between the first time T1 and the second time T2, whether the image is to be recorded by performing the first recording operation after performing the maintenance operation or by performing the second recording operation without performing the maintenance operation. On the other hand, in a case that the image is to be recorded on the second recording paper of which size is small, the controller 80 records the image always by performing the first recording operation after performing the maintenance operation. The aspect of the present disclosure, however, is not limited to this. For example, it is allowable that the controller 80 determines, based on the magnitude relationship between the first time T1 and the second time T2 but regardless of the size of the recording paper P, whether the image is to be recorded by performing the first recording operation after performing the maintenance operation or by performing the second recording operation without performing the maintenance operation.

In the above-described embodiment, in a case that there is an ejection defective nozzle and that the image is to be recorded by the normal recording mode of which resolution is low, the controller 80 determines, based on the magnitude relationship between the first time T1 and the second time T2, whether the image is to be recorded by performing the first recording operation after performing the maintenance operation or by performing the second recording operation without performing the maintenance operation. On the other hand, in a case that the image is to be recorded by the high resolution recording mode of which resolution is high, the controller 80 records the image always by performing the first recording operation after performing the maintenance operation. The aspect of the present disclosure, however, is not limited to this. For example, it is allowable that the controller 80 determines, based on the magnitude relationship between the first time T1 and the second time T2 but regardless of the resolution of the image to be recorded, whether the image is to be recorded by performing the first recording operation after performing the maintenance operation or by performing the second recording operation without performing the maintenance operation.

Further, in a case that the same image is to be recorded continuously on not less than a predetermined number of sheets of the recording paper P, the controller 80 determines, depending on whether or not the calculating time K is less than the time T1*a*, whether the first time T1 and the second time T2 are to be calculated based on the first recording time U1 and the second recording time U2 which are based on the image data, or whether the first time T1 and the second time T2 are to be calculated based on the first reference recording time R1 and the second reference recording time R2. The aspect of present disclosure, however, is not limited to this.

It is provided that a time which is obtained by multiplying the time T1*a* by a positive coefficient less than 1 is defined as a time T1*b*. For example, in a case that the same image is to be recorded continuously on not less than a predetermined number of sheets of the recording paper P, it is allowable that the controller 80 determines, depending on whether the calculating time K is less than the time T1*b*, whether the first time T1 and the second time T2 are to be calculated based on the first recording time U1 and the second recording time U2 based on the image data, or whether the first time T1 and the second time T2 are to be calculated based on the first reference recording time R1 and the second reference recording time R2. Note that in such a case, the condition that the calculating time K is less than the time T1*b* corresponds to the "predetermined condition" of the present disclosure. Alternatively, it is also allowable that the controller 80 performs the above-described determination based on whether or not the calculating time K satisfies another predetermined condition regarding the time T1*a*.

Alternatively, in the case that the same image is to be recorded continuously on not less than a predetermined number of sheets of the recording paper P, it is allowable that the controller 80 calculates the first recording time U1 and the second recording time U2 based on the image data but regardless of the calculating time K, and to calculate the first time T1 and the second time T2 based on the first recording time U1 and the second recording time U2.

Further, in the present embodiment, the controller 80 changes, depending on whether or not the same image is to be recorded on not less than the predetermined number of sheets of the recording paper P, whether the first time T1 and the second time T2 are to be calculated based on the first recording time U1 and the second recording time U2 based on the image data, and whether the first time T1 and the second time T2 are to be calculated based on the first reference recording time R1 and the second reference recording time R2. However, the aspect of the present disclosure is not limited to this. It is allowable, for example, that the controller 80 calculates the first time T1 and the second time T2 based on the first recording time U1 and the second recording time U2, regardless of the number of the recorded copy of the image. Alternatively, it is allowable that the controller 80 calculates the first time T1 and the second time T2 based the first reference recording time R1 and the second reference recording time R2, regardless of the number of the recorded copy of the image.

Furthermore, in the above-described embodiment, the controller 80 selectively performs, as the maintenance operation, any one of the plurality of kinds of suction purges which are different from each other in the driving time (driving period of time) of the suction pump 62. The aspect of the present disclosure, however, is not limited to this.

It is allowable, for example, that the controller 80 selectively performs, as the maintenance operation, any one of a plurality of kinds of flushing (flushing operations) by which the ink-jet head 4 is driven so as to discharge the ink from the nozzles 10 and which are different from each other in the number of times of driving of the ink-jet head 4. Note that in such a case, a time required for the operation is different among the plurality of kinds of flushing operations due to the difference in the number of times of driving of the ink-jet head 4. Further in this case, the ink-jet head 4 consequently functions both as the "head" and the "maintenance part" of the present disclosure.

Alternatively, it is allowable, for example, that the controller 80 selectively performs any one of a plurality of kinds of maintenance operations which include at least one kind of suction purge and at least one kind of flushing, and which are different from each other in the time required for the operation. Note that in such a case, the maintenance unit 8 and the ink-jet head 4 are combined to collectively correspond to the "maintenance part" of the present disclosure.

Further, the present disclosure is not limited to the configuration wherein the controller 80 selectively performs any one of the plurality of kinds of maintenance operations which are different from each other in the time required for the operation. It is allowable that the printer is configured to perform only one kind of the maintenance operation. Even in such a case, the time required for recording an image on the recording paper P by the second recording operation changes or varies depending on the number of the ejection defective nozzle, the distribution of the ejection defective nozzle, etc. Accordingly, it is significant to determine, based on the first time T1 and the second time T2, whether the image is to be recorded on the recording paper P by performing the first recording operation after performing the maintenance operation or whether the image is to be recorded on the recording paper P by performing the second recording operation without performing the maintenance operation.

Furthermore, in the above-described embodiment, the controller 80 performs the suction purge as the purge. The aspect of the present disclosure, however, is not limited to this. It is allowable, for example, to provide a pressure pump at an intermediate part of the tubes 13 connecting the sub tank 3 to the ink cartridges 15. Alternatively, it is allowable that the printer is provided with a pressure pump which is connected to the ink cartridges. Moreover, it is allowable that the controller 80 drives the pressure pump in a state that the plurality of nozzles 10 are covered by the cap 61 to thereby perform a so-called pressure purge of pressurizing the ink inside the ink-jet head 4 and of ejecting (exhausting) the ink inside the ink-jet head 4 from the nozzles 10. Note that in this case, the cap 61 and the pressure pump are combined so as to collectively correspond to the "maintenance part" of the present disclosure.

Further, in the purge, it is allowable that the controller 80 performs both of the suction by the suction pump 62 and the pressurization by the pressure pump. In this case, the maintenance unit 8 and the pressure pump are combined so as to collectively correspond to the "maintenance part" of the present disclosure.

Furthermore, in the above-described embodiment, in a case that the first time T1 is not more than the second time T2, the controller 80 performs the maintenance operation and then performs the first recording operation so as to record an image on the recording paper P. Moreover, in a case that the first time T1 is longer than the second time T2, the controller 80 performs the second recording operation, without performing the maintenance operation, so as to record the image on the recording paper P. The aspect of the present disclosure, however, is not limited to this.

For example, from the viewpoint of recovering the ejection defective nozzle as much as possible, it is allowable that the controller 80 performs the maintenance operation and then to perform the first recording operation so as to record an image on the recording paper P, in addition to the case that the first time T1 is not more than the second time T2, also in a case that the first time T1 is longer than the second time T2 and the difference between the first time T1 and the second time T2 is less than a predetermined time (a predetermined period of time). Further, in a case that the first time T1 is longer than the second time T2 and the difference between the first time T1 and the second time T2 is not less than the predetermined time, it is allowable that the controller 80 performs the second recording operation, without performing the maintenance operation, so as to record the image on the recording paper P.

Furthermore, in the above-described embodiment, in the second recording operation, the controller 80 allocates the all dots of the image, including the dot(s) allocated to the ejection defective nozzle(s) 10 among the plurality of nozzles 10 constructing the nozzle row 9, to nozzle(s) 10 included in the plurality of nozzles 10 constructing the same nozzle row 9 and different from the ejection defective nozzle(s) 10. By doing so, the controller 80 makes the conveyance amount of the recording paper P in the conveying operation to be smaller than that in the first recording operation. The aspect of present disclosure, however, is not limited to this. For example, in a case that a certain nozzle 10 which is included in the plurality of nozzles 10 constructing the nozzle row 9 and which ejects the black ink is determined to be the ejection defective nozzle, it is allowable that the controller 80 allocates a dot allocated to the certain nozzle 10 to three nozzles 10 which are included in the plurality of nozzles 10, which eject three color inks, respectively, and of which positions in the conveyance direction are same to that of the certain nozzle 10. Further, it is allowable that the controller 80 causes these three nozzles 10 to eject the three color inks so that the three color inks (dots of the three color inks, respectively) are overlapped to one another on the recording paper P. Note that in such a case, the conveyance amount of the recording paper P in the conveyance operation is same between the first recording operation and the second recording operation.

Further, in the above-described embodiment, the controller 80 calculates the first time T as the time obtained by adding the time required for performing the maintenance operation and the time required for performing recording of the image on the recording paper P by the first recording operation. The aspect of present disclosure, however, is not limited to this. It is allowable, for example, that the controller 80 calculates the first time T1 by adding a time required for moving the carriage 2 after the maintenance operation to a position for staring the recording of the image by the first recording operation to the total of the time required for performing the maintenance operation and the time required for performing the recording of the image on the recording paper P by the first recording operation.

Furthermore, in the above-described embodiment, the signal indicating as to whether or not the nozzle 10 is an ejection defective nozzle is outputted from the determining circuit 68 in accordance with the voltage value of the detecting electrode 66 in the case that the ink is ejected from the nozzle 10 toward the detecting electrode 66. The aspect of the present disclosure, however, is not limited to this.

For example, it is possible to arrange a detecting electrode extending in an up-down direction. In this case, it is allowable that the determining circuit outputs a signal regarding as to whether or not the nozzle 10 is an ejection defective nozzle, depending on a voltage value of the detecting electrode in a case that the ink is ejected from the nozzle 10 so that the ejected ink passes through an area facing the detecting electrode. Alternatively, it is allowable to provide an optical sensor (corresponding to the "signal generator" of the present disclosure) which detects the ink ejected from the nozzle 10. Further, it is allowable that the optical sensor outputs a signal regarding whether or not the nozzle 10 is an ejection defective nozzle.

Still alternatively, it is allowable, for example, to connect a voltage detecting circuit (corresponding to the "signal generator" of the present disclosure), which detects the change in voltage in a case that the ink is ejected from the nozzle of the ink-jet head, to a plate of the ink-jet head in which the nozzles are formed, in a similar manner as described in Japanese Patent No. 4,929,699. Further, it is allowable that the voltage detecting circuit outputs, to the controller 80, a signal regarding whether or not the nozzle 10 is the ejection defective nozzle. The contents described in Japanese Patent No. 4,929,699 is incorporated herein by reference in its entirety.

Yet still alternatively, it is allowable, for example, that a substrate of the ink-jet head is provided with a temperature detecting element (corresponding to the "signal generator" of the present disclosure), in a similar manner as described in Japanese Patent No. 6,231,759. Further, it is allowable that, after the controller 80 drives the heater so that a first application voltage is applied so as to eject the ink, the controller 80 drives the heater so that a second application voltage is applied so as not to allow the ink to be ejected, and then the temperature detecting elements outputs, to the controller 80, a signal regarding whether the nozzle 10 is an ejection defective nozzle, based on the change in the temperature detected by the temperature detecting element during a period of time since the heater has been driven as described above and until a predetermined time elapses. The contents described in Japanese Patent No. 6,231,759 is incorporated herein by reference in its entirety.

Further, in the above-described embodiment, whether or not the ink is ejected from the nozzle 10 is detected, and a nozzle 10 from which the ink is not ejected is determined as an ejection defective nozzle. The aspect of the present disclosure, however, is not limited to this. For example, it is allowable to provide a sensor configured to detect the ejecting velocity and/or the ejecting direction, etc., of the ink from the nozzle 10. Further, it is allowable that the controller 80 determines that a nozzle 10, in which the ejecting velocity and/or the ejecting direction, etc., of the ink is/are abnormal to be an ejection defective nozzle, based on the output from the sensor.

Furthermore, in the foregoing, the explanation has been given about the example wherein the present disclosure is applied to the printer which ejects the ink from the nozzles to thereby perform recording on the recording paper P. The aspect of the present disclosure, however, is not limited to this configuration. For example, the present disclosure is applicable also to a printer configured to record an image on a recording medium which is different from the recording paper, and which is exemplified, for example, by a T-shirt, a sheet for outdoor advertisement, a case of a mobile terminal such as a smartphone, etc., a corrugated cardboard, a resin member, etc. Further, the present disclosure is applicable also to a liquid ejection apparatus which is configured to eject a liquid different from the ink, for example, a liquefied resin or metal, etc.

What is claimed is:

1. A liquid ejection apparatus comprising:

a head in which a plurality of nozzles are open;

a carriage mounting the head and configured to move the head in a scanning direction;

a conveyor configured to convey a medium in a conveyance direction crossing the scanning direction;

a signal generator configured to output a signal that is selected among a plurality of signals depending on whether or not the plurality of nozzles include an ejection defective nozzle which has defectiveness in ejecting of a liquid;

a maintenance part configured to perform a maintenance operation for recovering the ejection defective nozzle; and a controller configured to execute:

ejecting of the liquid toward the medium by an ejecting operation of performing an ejecting pass of causing the liquid to be ejected from the plurality of nozzles while moving the carriage in the scanning direction and a conveying operation of causing the conveyor to convey the medium; and before the ejecting operation, determining of whether or not the ejection defective nozzle is present among the plurality of nozzles, based on the signal from the signal generator, and in a case that the controller determines that the ejection defective nozzle is present among the plurality of nozzles, determining, based on a first time and a second time, of whether to perform a first ejecting operation after performing the maintenance operation, or to perform a second ejecting operation without performing the maintenance operation, wherein the first ejecting operation is the ejecting operation in which all the plurality of nozzles are used in the ejecting pass, and the first time is a time required for performing the ejecting of the liquid toward the medium by the first ejecting operation, and wherein the second ejecting operation is the ejecting operation in which only nozzles, included in the plurality of nozzles and different from the ejection defective nozzle, are used in the ejecting pass, and the second time is a time required for performing the ejecting of the liquid toward the medium by the second ejecting operation.

2. The liquid ejection apparatus according to claim 1, wherein the controller is configured to calculate the first time by calculating the time required for performing the ejecting of the liquid toward the medium by the first ejecting operations, and the second time by calculating the time required for performing the ejecting of the liquid toward the medium by the second ejecting operation.

3. The liquid ejection apparatus according to claim 1, wherein in a case that the controller determines that the ejection defective nozzle is present among the plurality of nozzles and that the first time is shorter than the second time, the controller is configured to perform the first ejecting operation after performing the maintenance operation, and wherein in a case that the controller determines that the ejection defective nozzle is present among the plurality of nozzles and that the second time is shorter than the first time, the controller is configured to perform the second ejecting operation, without performing the maintenance operation before performing the second ejection operation.

4. The liquid ejection apparatus according to claim 1, wherein the maintenance operation includes a plurality of kinds of maintenance operations which are different from each other in a time required for operation, wherein the maintenance part is configured to selectively perform one of the plurality of kinds of maintenance operations, wherein in the case that the controller determines that the ejection defective nozzle is present among the plurality of nozzles, the controller is configured to execute:

determining of which one of the plurality of kinds of maintenance operations is to be performed, based on a result of the determining of whether or not the ejection defective nozzle is present among the plurality of nozzles; and determining of whether to perform the first ejecting operation after performing the maintenance operation, or to perform the second ejecting operation without performing the maintenance operation, based on a time for performing a determined maintenance operation which is determined among the plurality of kinds of maintenance operations, the first time and the second time.

5. The liquid ejection apparatus according to claim 1, wherein the controller is configured to execute:

converting of input image data to ejection data for causing the liquid to be ejected from the plurality of nozzles; and causing of the liquid to be ejected from the plurality of nozzles in the ejecting pass based on the ejection data, wherein the liquid ejection apparatus further comprises a memory configured to previously store first reference time information regarding a time required for recording an image, corresponding to the image data, one time by the first ejecting operation, and second reference time information regarding a time required for recording the image, corresponding to the image data, one time by the second ejecting operation, wherein in a case that the controller determines that the ejection defective nozzle is present among the plurality of nozzles and that the controller performs recording of the image corresponding to the image data only one time, and in a case that the controller determines that the ejection defective nozzle is present among the plurality of nozzles and that the controller performs the recording of a same image, as the image corresponding to the image data, repeatedly a number of times which is less than a predetermined number of times, the controller is configured to execute:

calculating of the first time based on the first reference time information and the number of times in which the image is to be recorded; and calculating of the second time based on the second reference time information and the number of times in which the image is to be recorded, and wherein in a case that the controller determines that the ejection defective nozzle is present among the plurality of nozzles, and that the controller performs the recording of the same image, as the image corresponding to the image data, repeatedly a number of times which is not less than the predetermined number of times, the controller is configured to execute:

calculating of a first recording time required for recording the image based on the image data one time by the first ejecting operation, and calculating of a second recording time required for recording the image based on the image data one time by the second ejecting operation;

calculating of the first time based on the first recording time and the number of times in which the image is to be recorded; and calculating of the second time based on the second recording time and the number of times in which the image is to be recorded.

6. The liquid ejection apparatus according to claim 5, wherein in the case that the controller determines that the ejection defective nozzle is present among the plurality of nozzles, the controller is configured to execute calculating of a calculating time required for the calculating of the first recording time and the calculating of the second recording time based on the input image data, wherein in a case that the controller determines that the ejection defective nozzle is present among the plurality of nozzles, that the controller causes the same image, as the image corresponding to the image data, to be recorded for the number of times which is not less than the predetermined number of times, and that the calculating time satisfies a predetermined condition regarding the first time which is calculated based on the first reference time information and the number of times in which the image is to be recorded, the controller is configured to execute:

calculating of the first time based on the first reference time information and the number of times in which the image is to be recorded; and calculating of the second time based on the second reference time information and the number of times in which the image is to be recorded.

7. The liquid ejection apparatus according to claim 1, wherein the controller is configured to execute the ejecting operation selectively in either one of a first eject mode and a second eject mode in which the liquid is caused to be ejected from the plurality of nozzles such that dots of the liquid are formed in the medium at a resolution being higher than that in the first eject mode, wherein in a case that the controller determines that the ejection defective nozzle is present among the plurality of nozzles, and that the controller performs the ejecting operation in the first eject mode, the controller is configured to execute the determining, based on the first time and the second time, of whether to perform the first ejecting operation after performing the maintenance operation, or to perform the second ejecting operation without performing the maintenance operation, and wherein in a case that the controller determines that the ejection defective nozzle is present among the plurality of nozzles, and that the controller performs the ejecting operation in the second eject mode, the controller is configured to perform the first ejecting operation after performing the maintenance operation.

8. The liquid ejection apparatus according to claim 1, wherein the medium includes a first medium and a second medium having a size smaller than a size of the first medium, wherein in a case that the controller determines that the ejection defective nozzle is present among the plurality of nozzles, and that the controller causes the liquid to be ejected from the plurality of nozzles in the ejecting operation toward the first medium, the controller is configured to execute the determining, based on the first time and the second time, of whether to perform the first ejecting operation after performing the maintenance operation, or to perform the second ejecting operation without performing the maintenance operation, and wherein in a case that the controller determines that the ejection defective nozzle is present among the plurality of nozzles, and that the controller causes the liquid to be ejected from the plurality of nozzles in the ejecting operation toward the second medium, the controller is configured to execute the first ejecting operation after performing the maintenance operation.

9. The liquid ejection apparatus according to claim 1, wherein the head has a nozzle row including the plurality of nozzles which are aligned in the conveyance direction, and wherein in the second ejecting operation, the controller is configured to execute:

allocating of all of eject of the liquid including eject of the liquid allocated to the ejection defective nozzle among the plurality of nozzles constructing the nozzle row in the first ejecting operation, to nozzles included in the plurality of nozzles constructing the nozzle row and different from the ejection defective nozzle so as to perform the ejecting pass; and making of a conveyance amount of the medium in the conveying operation to be different from a conveyance amount of the medium in the conveying operation in the first ejecting operation, in accordance with the allocating of all of the eject of the liquid to the nozzles different from the ejection defective nozzle in the ejecting pass.

* * * * *